US009205905B2

(12) United States Patent
Li

(10) Patent No.: US 9,205,905 B2
(45) Date of Patent: Dec. 8, 2015

(54) WATERPROOF ROTARY CONTACT ASSEMBLY

(71) Applicant: JLIP, LLC, Dania Beach, FL (US)

(72) Inventor: Raymond Li, Fort Lauderdale, FL (US)

(73) Assignee: JLIP, LLC, Wilmington, DE (US)

( * ) Notice: Subject to any disclaimer, the term of this patent is extended or adjusted under 35 U.S.C. 154(b) by 0 days.

(21) Appl. No.: 14/212,000

(22) Filed: Mar. 14, 2014

(65) Prior Publication Data

US 2014/0273542 A1 Sep. 18, 2014

Related U.S. Application Data

(60) Provisional application No. 61/801,257, filed on Mar. 15, 2013.

(51) Int. Cl.

| | |
|---|---|
| ***B63H 11/08*** | (2006.01) |
| *H01R 35/02* | (2006.01) |
| *B63H 11/00* | (2006.01) |

(52) U.S. Cl.

CPC ..... *B63H 11/08* (2013.01); *B63H 2011/006* (2013.01); *B63H 2011/081* (2013.01); *H01R 35/02* (2013.01)

(58) Field of Classification Search

USPC ..... 439/21, 17, 86, 89, 669, 668; 174/80, 174/77 C, 88 C

See application file for complete search history.

(56) References Cited

U.S. PATENT DOCUMENTS

| | | | | |
|---|---|---|---|---|
| 2,704,355 | A * | 3/1955 | Holton | 439/281 |
| 3,301,053 | A * | 1/1967 | Walch, Jr. et al. | 73/861.78 |
| 3,344,391 | A * | 9/1967 | Ruete | 439/89 |
| 4,074,926 | A * | 2/1978 | Broad | 439/89 |
| 4,314,093 | A * | 2/1982 | Eldridge et al. | 174/73.1 |
| 4,426,127 | A * | 1/1984 | Kubota | 439/607.17 |
| 4,690,212 | A * | 9/1987 | Termohlen | 166/65.1 |
| 5,866,824 | A * | 2/1999 | Schieber | 73/861.79 |
| 6,612,847 | B2 * | 9/2003 | Canizales, Jr. | 439/17 |
| 6,663,395 | B2 * | 12/2003 | Sobhani | 439/21 |
| 7,306,469 | B1 * | 12/2007 | Slautterback et al. | 439/86 |
| 7,648,378 | B2 * | 1/2010 | Funke | 439/194 |
| 8,096,193 | B2 * | 1/2012 | Fink et al. | 73/861.79 |
| 8,206,181 | B2 * | 6/2012 | Steijner | 439/669 |
| 2008/0009198 | A1 * | 1/2008 | Marino | 439/668 |

* cited by examiner

*Primary Examiner* — Alexander Gilman
(74) *Attorney, Agent, or Firm* — Nicholas R. Lewis

(57) ABSTRACT

A conduit assembly, including a first conduit segment defining a passage therethrough; a first housing affixed to the first conduit segment within the passage; a first plurality of electrical conductors attached to the first housing; a second conduit segment rotatably coupled to the first conduit segment; a second housing affixed to the second conduit; and a second plurality of electrical conductors attached to the second housing, where the second plurality of electrical conductors are in electrical communication with and rotatable about the first plurality of electrical conductors.

16 Claims, 3 Drawing Sheets

LONGITUDINAL SECTION B-B

LONGITUDINAL SECTION B-B

TOP VIEW A-A

END VIEW C

WATERPROOF ROTARY CONTACT ASSEMBLY

CROSS-REFERENCE TO RELATED APPLICATION

This application is related to and claims priority to U.S. Provisional Patent Application Ser. No. 61/801,257, filed Mar. 15, 2013, entitled "Waterproof Rotary Contact Assembly," the entirety of which is incorporated herein by reference.

STATEMENT REGARDING FEDERALLY SPONSORED RESEARCH OR DEVELOPMENT n/a

FIELD OF THE INVENTION

The present invention relates to electrical rotary contact configurations, and particularly, towards an electrical contact assembly configured to rotate or spin and/or to withstand high fluid flow and pressures.

BACKGROUND OF THE INVENTION

Recently, a number of water-powered recreational vehicles have become available, such as those described in U.S. Pat. Nos. 7,258,301 and 8,336,805. These devices have a user-supporting or "body unit" assembly that allows a person to fly above the water. The body unit receives pressurized fluid through a hose attached to a personal watercraft that remains on the surface of the water. The body unit of these devices can include a throttle control or other input device that electronically communicates with the watercraft providing the pressurized fluid to the body unit. The electronic communication is provided through a cable or wire that runs along the length of the hose. However, during operation of these recreational vehicles, numerous maneuvers may be performed that can twist or otherwise exert large amounts of force on the electrical cable or wire. In addition, the devices employ high pressure fluid flow (including salt water if used in the ocean) in the immediate vicinity to the electronic cable or wire. If the electrical cable is located inside the hose, the fluid flow could damage the electrical cable. If the electrical cable is located along the outside of the hose, the electrical cable may be damaged by the twisting action. These conditions present challenges for typical electrical rotary contact configurations. The present disclosure provides improved electrical rotary contact systems to overcome such harsh performance conditions.

SUMMARY OF THE INVENTION

The present invention advantageously provides a conduit assembly, including a first conduit segment defining a passage therethrough; a first housing affixed to the first conduit segment within the passage; a first plurality of electrical conductors attached to the first housing; a second conduit segment rotatably coupled to the first conduit segment; a second housing affixed to the second conduit; and a second plurality of electrical conductors attached to the second housing, where the second plurality of electrical conductors are in electrical communication with and rotatable about the first plurality of electrical conductors. The first and second housings may each define a substantially rounded exterior surface. The first and/or second housings may define a reservoir therein. The reservoirs of the first and/or second housings may each be substantially filled with a non-electrically-conductive fluid. The first and/or second housings may be substantially waterproof. The first housing and the second housing may be rotatable about a common axis. The assembly may include a fluid source in fluid communication with the passage. The first housing may be affixed to the first conduit segment by a first fin and/or the second housing may be affixed to the second conduit segment by a second fin. The assembly may include a first plurality of wires coupled to the first plurality of electrical conductors, where the first plurality of wires extend along an exterior of the first conduit segment. The assembly may include a second plurality of wires coupled to the second plurality of electrical conductors, wherein the second plurality of wires extend along an exterior of the second conduit segment.

A fluid conduit assembly is provided, including a first conduit segment defining a fluid passage therethrough; a first housing affixed to the first conduit segment within the passage, the first housing defining a substantially rounded exterior surface; a first plurality of substantially circular electrical conductors attached to the first housing; a second conduit segment rotatably coupled to the first conduit segment; a second housing affixed to the second conduit, the second housing defining a substantially rounded exterior surface; and a second plurality of electrical conductors attached to the second housing, where the second plurality of electrical conductors are in electrical communication with and rotatable about the first plurality of electrical conductors. The first and/or second housings may be substantially waterproof. The first and second housings may each be substantially filled with a non-electrically-conductive fluid. The assembly may include a fluid source in fluid communication with the passage. The first housing may be affixed to the first conduit segment by a first fin having a width substantially smaller than a width of the first housing; and the second housing may be affixed to the second conduit segment by a second fin having a width substantially smaller than a width of the second housing.

A rotary housing assembly is disclosed, including a first housing including a first plurality of substantially circular electrical conductors; a second housing rotatably coupled to the first housing, the second housing including a second plurality of electrical conductors in electrical communication with and rotatable about the first plurality of electrical conductors, wherein the first and second housings are substantially waterproof. The first and second housings may each define substantially rounded exterior surfaces and/or each include a substantially bullet-shaped exterior profile.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

The present disclosure provides an electrical rotary contact configuration that can withstand high pressure fluid flow. In general, the disclosed rotary contacts system includes an upstream and downstream sections that allow multiple control cable conductors or wires to run outside of a fluid delivery conduit or hose to increase cable protection, yet allow the downstream section to spin indefinitely while maintaining contact and signal integrity. The disclosed configuration allows the electrical control cable to be at least partially positioned outside of a pipe/hose delivering pressurized fluid so that the system can withstand significantly high operating pressures and turbulence experienced in applications such as the water-powered flying devices described above. The disclosed configuration allows passage of electrical currents through multiple conductors in a rotary contact device which has a rigid housing supported by one or more hollow fins attached to the wall of the respective conduits. One or more bearings may keep the rotary contact device aligned at or near the center of rotation to allow electrical currents to pass between the individual contacts on a stationery stack of contacts and corresponding contacts on a rotary assembly of alternating disk-like contacts separated by disk-like insulators.

Figure 1:
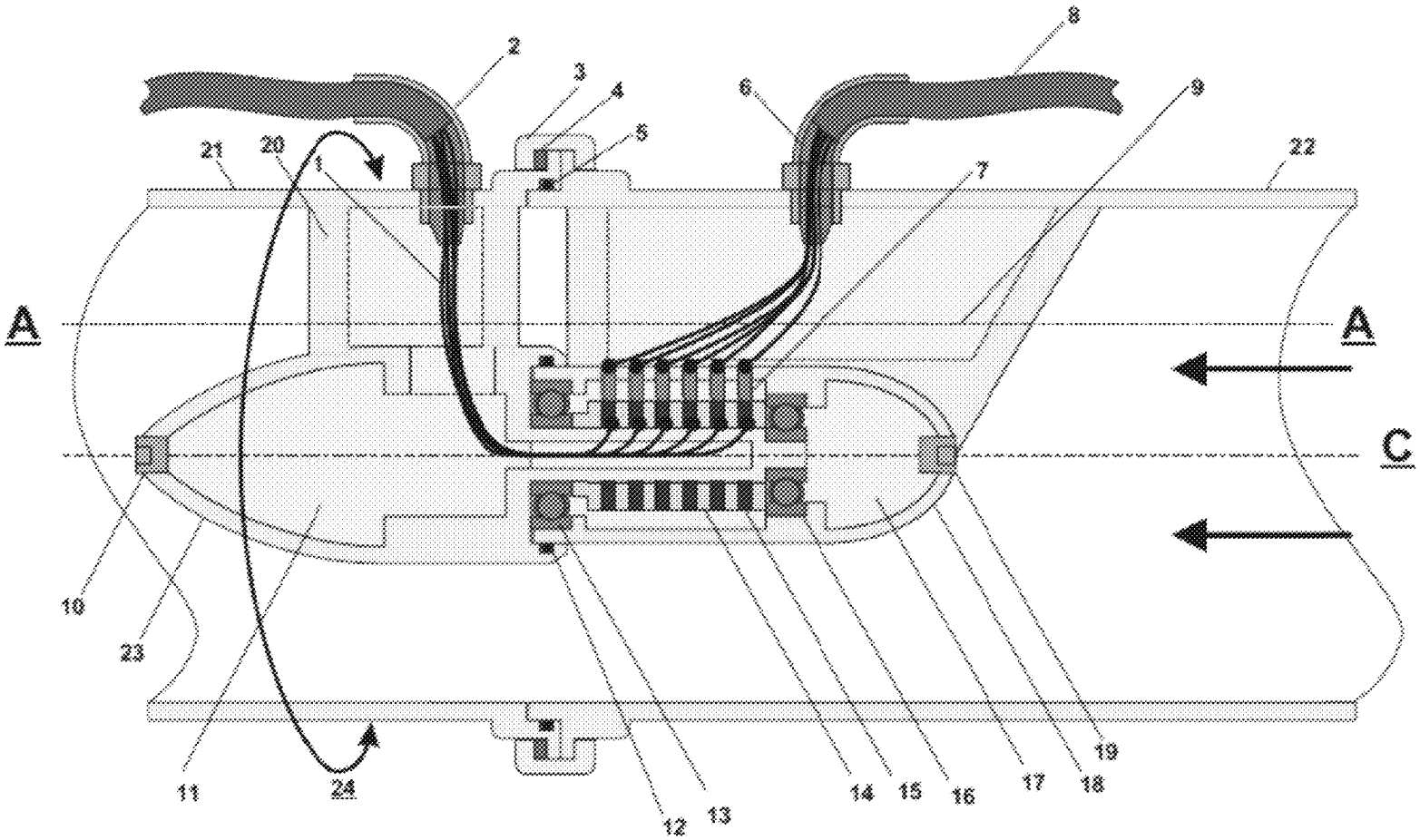
FIG. 1 is a cross-sectional view of an example of an electrical rotary contact configuration constructed in accordance with the principles of the present disclosure.
Figure 2:
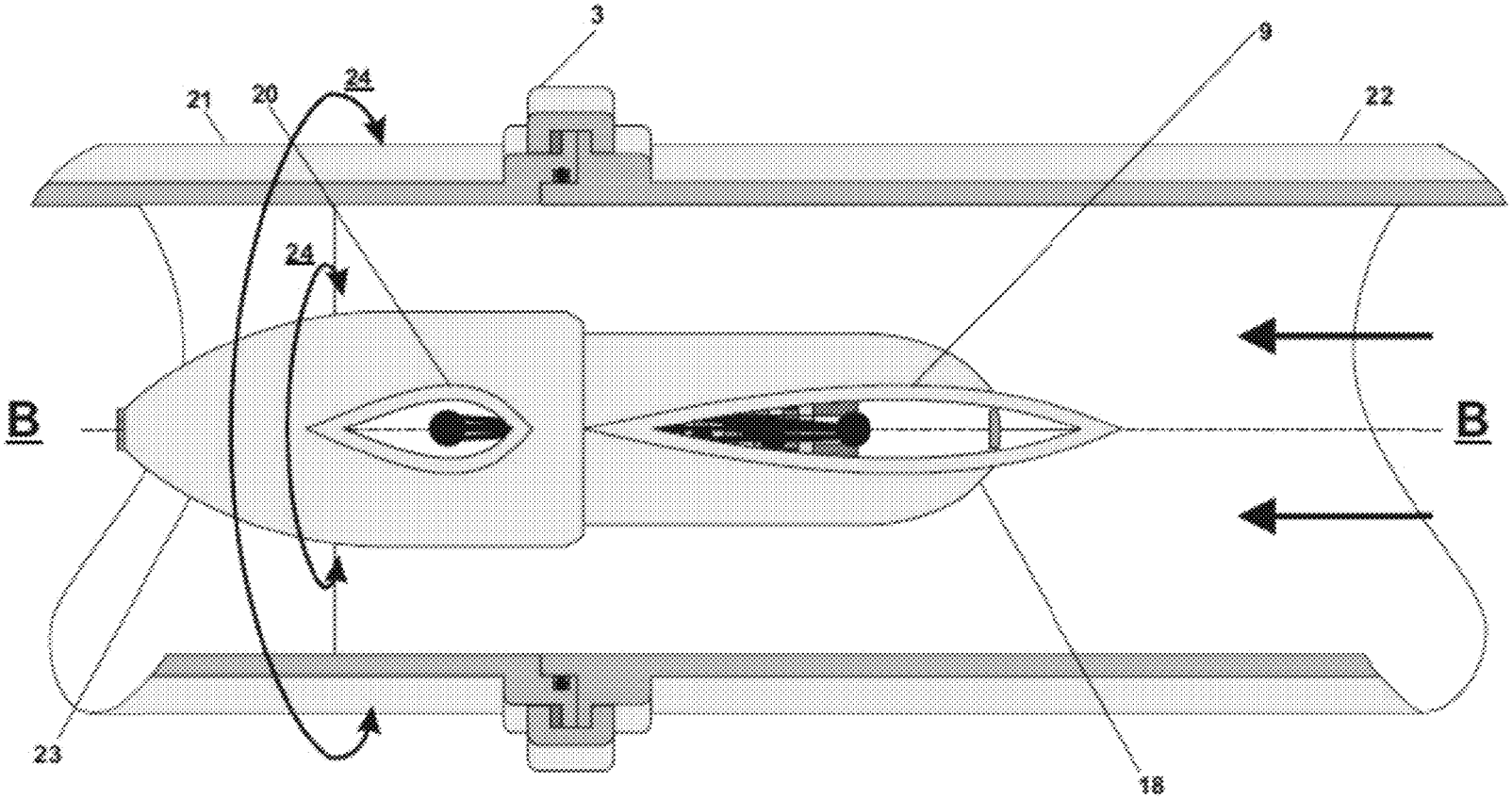
FIG. 2 is another cross-sectional view of the electrical rotary contact configuration of FIG. 1.
Figure 3:
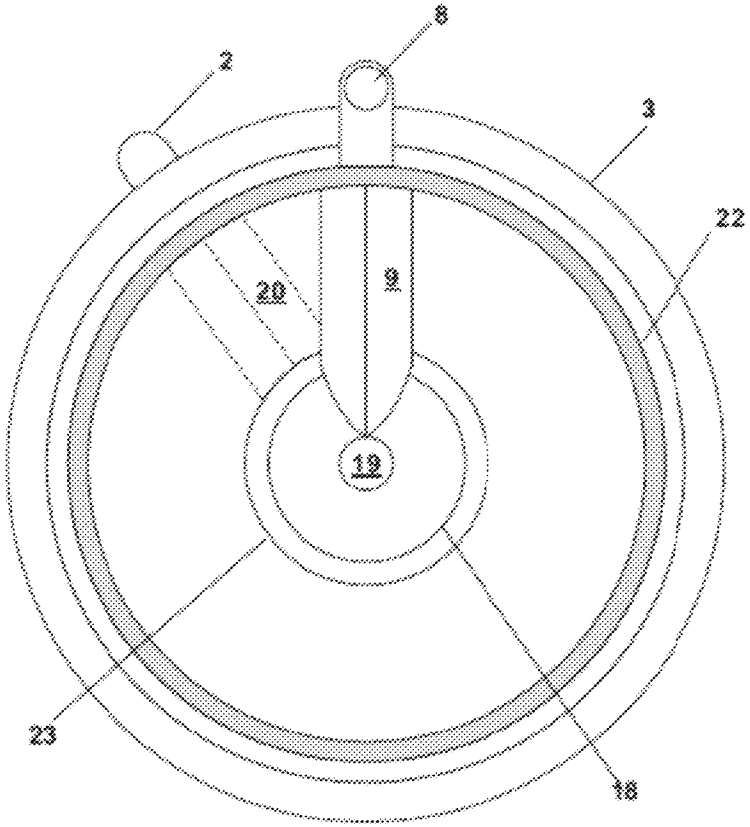
FIG. 3 is another cross-sectional view of the electrical rotary contact configuration of FIG. 1.

Referring to FIGS. 1-3, an example of an electrical rotary contact configuration constructed in accordance with the present disclosure may include the following correspondingly-numbered components: "Downstream" conductors 1; "Downstream" elbow fitting 2; Half clamshell clamps 3 coupling "downstream" conduit and "upstream" conduit; Flat bushing (bearing) 4; O-ring seal 5; "Upstream" elbow fitting 6; Upstream Rotary Contacts 7; "Upstream" electrical cable 8; "Upstream" rotary housing support fin 9; "Downstream" rotary housing reservoir cap 10; "Downstream" rotary housing reservoir 11; Rotary contact housing O-ring 12; Rotary housing bearing 13; Rotary contact insulator disks 14; Downstream rotary contact conductors 15; Rotary housing bearing 16; "Upstream" rotary housing oil reservoir 17; "Upstream" rotary housing 18; "Upstream" rotary housing oil filler cap 19; "Downstream" rotary housing support fin 20; "Downstream" conduit segment 21; "Upstream" conduit segment 22; "Downstream" rotary housing 23; Rotation of "downstream" conduit relative to "upstream" conduit 24.

As used herein, the terms upstream and downstream are used to indicate a relative position with respect to a direction of fluid flow within the conduit or hose having the contact assembly as described herein. An example of a fluid flow direction is indicated by arrows adjacent the "A" and "C" labels in FIG. 1, but the components described herein may be oriented in the opposite direction with respect to the fluid flow as well.

The electrical rotary contact configuration shown in FIGS. 1-3 generally includes the first, downstream conduit segment 21 rotatably coupled to the second, upstream conduit segment 22. The conduit segments may be portions of a fluid delivery hose or conduit, such as those used to deliver pressurized water from a pressurized fluid source such as a personal watercraft to a water-propelled personal propulsion device, and may be rotatable with respect to another as indicated by the arrow 24. The conduit segments may be substantially coaxial and define a fluid flow path therethrough, and may be fluidically sealed or otherwise substantially waterproof at a joint therebetween. The first and second conduit segments 21, 22 may be sealed together through the use of one or more clamps, seals, bearing, o-rings, or the like, such as the clamps 3, flat bushing (or bearing) 4; and/or the o-ring seal 5.

The first, downstream rotary housing 23 and the second, upstream rotary housing 18 are coupled to the first and second conduit segments 21, 22 respectively, within the fluid flow path defined therethrough. Each of the first and second rotary housings 23, 18 may define substantially rounded exterior surfaces and/or bullet-shaped or bull-nosed tips to minimize turbulence and disruption of fluid flowing past an exterior of the housings within the conduit segments. The smooth, fluid dynamic shape of the housings not only reduces turbulence and fluid flow disruption within the conduit, but in turn also reduces the forces experienced by the rotary contact components and thus provides longevity and durability of the assembly, and also reduces any possible performance loss of the device(s) receiving the pressurized fluid from the conduit due to any disruption of the fluid flow within the conduit.

The first and second rotary housings 23, 18 may be connected or affixed to their respective conduit segments 21, 22 by the first, downstream fin 20 and the second, upstream fin 9. The first and second fins may define a cross-sectional width substantially less than or narrower than a cross-sectional width of the first and second rotary housings to minimize fluid flow disruption. For example, the fins may each define a width that is less than or equal to approximately 30% of the width of a width of the first and/or second rotary housings. The first and second fins may define rounded or tapered edges to further reduce any turbulent affect on fluid flow passing through the conduit segments.

The first and second rotary housings 23, 18, and/or the first and second support fins 20, 9 may define interior cavities or reservoirs for wires or other components to pass through, and may also be substantially filled with an insulating or non-electrically-conductive fluid, compound, or resin to seal, protect, or otherwise insulate the interior components from exterior fluids. The first and second rotary housings may include reservoir caps 10, 19, respectively, to allow access to add fluid or compound to the interior reservoirs.

The assembly includes a first plurality of electrical conductors 15 disposed within or otherwise coupled to the first rotary housing 23. The electrical conductors 15 may be substantially rounded, circular, or disc-shaped, and may be spaced apart by a plurality of insulator discs or components 14. The electrical conductors 15 may be in electrical communication with and rotatable with respect to the second plurality of conductors 7 disposed within or otherwise attached to the second rotary housing 18.

Through the rotatable connection between the fluid conduit segments, and the first and second rotary housing, the first and second pluralities of electrical conductors remain in contact throughout a full range of rotation of the respective components to provide uninterrupted communication. In the example shown, 6 conductors are illustrated. However, the presently-disclosed electrical rotary contact configuration can accommodate virtually any number of electrical contacts, which may for example, be increased by incorporating alternating number of contact disks and insulator disks, with the contact disks making contact with corresponding stationary contacts in the upstream housing.

The disclosed configuration can withstand the turbulence, pressure and salt water by employing one or more of the following features: (1) the cables or wires may be protected by cable sleeves outside of the fitting and rigid housings one upstream and one downstream, which are rotatably coupled, (2) one or more fins may provide substantially rigid support and cable passage between the cables outside and the inside of the two rotatably coupled housings, where the downstream assembly of fin, housing and contact disks can rotate freely within the confines of multiple bearings, (3) multiple bearings may provide co-linearity and resist the forces generated by internal pressures that would otherwise pull the housings apart, and (4) the housings may be oil-filled to provide cooling and lubrication and prevent corrosion, and (5) multiple seals may keep water outside and the protective oil or substance inside.

The fins with hollow passages may be sealed against the outside as well as the pressurized stream inside the pipes/fittings. The center bearings keep the upstream and downstream housings co-linear while the flange bearing withstands any separation tension and/or forces generated by internal water pressure. For example, in the case of the recreational water-powered vehicles described above, a hose may have a 12 sq.in. cross sectional area with approx. 60-70 psi pressure, resulting in approximately 700-840 lbf of forces on the flange and bearing surfaces of the rotary contact configuration. To counteract theses forces, the flanges may be kept together by a pair of clam-style channel clamps which create two gaps, so that an additional bearing race may be included to provide an unbroken low friction surface (not shown). It is also contemplated that a quick connect clamp may be included further upstream from the upstream rotary contact housing to connect/disconnect the conduit from a vehicle or device receiving fluid from the conduit.

Additional disclosure regarding personal propulsion devices can be found in U.S. Pat. Nos. 7,258,301 and 8,336,805, the entirety of all of which is expressly incorporated herein It will be appreciated by persons skilled in the art that the present invention is not limited to what has been particularly shown and described herein above. In addition, unless mention was made above to the contrary, it should be noted that all of the accompanying drawings are not to scale. Of note, the system components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. Moreover, while certain embodiments or figures described herein may illustrate features not expressly indicated on other figures or embodiments, it is understood that the features and components of the examples disclosed herein are not necessarily exclusive of each other and may be included in a variety of different combinations or configurations without departing from the scope and spirit of the invention. A variety of modifications and variations are possible in light of the above teachings without departing from the scope and spirit of the invention, which is limited only by the following claims.

What is claimed is:

1. A conduit assembly, comprising:

a first conduit segment defining a passage therethrough;

a first housing affixed to the first conduit segment within the passage, wherein the first housing defines a reservoir therein;

a first plurality of electrical conductors attached to the first housing;

a second conduit segment rotatably coupled to the first conduit segment;

a second housing affixed to the second conduit, wherein the second housing defines a reservoir therein, and wherein the reservoirs of the first and second housings are each substantially filled with a non-electrically-conductive fluid; and a second plurality of electrical conductors attached to the second housing, wherein the second plurality of electrical conductors are in electrical communication with and rotatable about the first plurality of electrical conductors.

2. The conduit assembly of claim 1, wherein the first and second housings each define a substantially rounded exterior surface.

3. The conduit assembly of claim 1, wherein the first and second housings are substantially waterproof.

4. The conduit assembly of claim 1, wherein the first housing and the second housing are rotatable about a common axis.

5. The conduit assembly of claim 1, further comprising a fluid source in fluid communication with the passage.

6. The conduit assembly of claim 1, wherein the first housing is affixed to the first conduit segment by a first fin.

7. The conduit assembly of claim 6, wherein the second housing is affixed to the second conduit segment by a second fin.

8. The conduit assembly of claim 1, further comprising a first plurality of wires coupled to the first plurality of electrical conductors, wherein the first plurality of wires extend along an exterior of the first conduit segment.

9. The conduit assembly of claim 8, further comprising a second plurality of wires coupled to the second plurality of electrical conductors, wherein the second plurality of wires extend along an exterior of the second conduit segment.

10. A fluid conduit assembly, comprising:

a first conduit segment defining a fluid passage therethrough;

a first housing affixed to the first conduit segment within the passage, the first housing defining a substantially rounded exterior surface;

a first plurality of substantially circular electrical conductors attached to the first housing;

a second conduit segment rotatably coupled to the first conduit segment;

a second housing affixed to the second conduit, the second housing defining a substantially rounded exterior surface, wherein the first and second housings are each substantially filled with a non-electrically-conductive fluid; and a second plurality of electrical conductors attached to the second housing, wherein the second plurality of electrical conductors are in electrical communication with and rotatable about the first plurality of electrical conductors.

11. The assembly of claim 10, wherein the first and second housings are substantially waterproof.

12. The assembly of claim 10, further comprising a fluid source in fluid communication with the passage.

13. The assembly of claim 10, wherein the first housing is affixed to the first conduit segment by a first fin having a width substantially smaller than a width of the first housing; and wherein the second housing is affixed to the second conduit segment by a second fin having a width substantially smaller than a width of the second housing.

14. A rotary housing assembly, comprising:

a first housing including a first plurality of substantially circular electrical conductors; and a second housing rotatably coupled to the first housing, the second housing including a second plurality of electrical conductors in electrical communication with and rotatable about the first plurality of electrical conductors, wherein the first and second housings are substantially waterproof, and wherein the first and second housings are each substantially filled with a non-electrically-conductive fluid.

15. The assembly of claim 14, wherein the first and second housings each define substantially rounded exterior surfaces.

16. The assembly of claim 14, wherein the first and second housings each include a substantially bullet-shaped exterior profile.

* * * * *